US011622643B1

(12) United States Patent
O'Connor

(10) Patent No.: US 11,622,643 B1
(45) **Date of Patent: *Apr. 11, 2023**

(54) LIGHTED MAILBOX POST OR SIMILAR STRUCTURE

(71) Applicant: Brody M. O'Connor, Riverdale, UT (US)

(72) Inventor: Brody M. O'Connor, Riverdale, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/844,933

(22) Filed: Jun. 21, 2022

Related U.S. Application Data

(63) Continuation-in-part of application No. 17/144,127, filed on Jan. 7, 2021, now Pat. No. 11,363,900.

(60) Provisional application No. 62/963,955, filed on Jan. 21, 2020.

(51) Int. Cl.
*A47G 29/122* (2006.01)
*F21S 4/28* (2016.01)
*A47G 29/12* (2006.01)

(52) U.S. Cl.
CPC ..... *A47G 29/1225* (2013.01); *A47G 29/121* (2013.01); *A47G 29/1216* (2013.01); *F21S 4/28* (2016.01); *A47G 2029/1226* (2013.01)

(58) Field of Classification Search
CPC ..... A47G 29/1225; A47G 29/121; A47G 29/1216; A47G 2029/1226; F21S 4/28
See application file for complete search history.

(56) References Cited

U.S. PATENT DOCUMENTS

| | | | |
|---|---|---|---|
| 5,143,285 | A | 9/1992 | Wise |
| 8,631,998 | B1 | 1/2014 | Connelly et al. |
| 11,363,900 | B1 | 6/2022 | O'Connor |
| 2006/0104055 | A1 | 5/2006 | Bossomo |
| 2007/0241922 | A1 | 10/2007 | Brannon |

OTHER PUBLICATIONS

Brody Jeanna O'Conner, Facebook post, Nov. 1, 2017, www.facebook.com.
Eco-Friendly Solar Products, Solar mailbox address light with rechargeable batteries, https://nextthing.com, accessed Jan. 13, 2020.
LED Mailboxes, https://ledmailboxes.com/product/express-mail/, accessed Jan. 21, 2021.

(Continued)

*Primary Examiner* — Mary Ellen Bowman
(74) *Attorney, Agent, or Firm* — Workman Nydegger

(57) ABSTRACT

A reconfigurable lighted post (e.g., mailbox), including a post, and first and second dual channel members attached to the post. The dual channel members include dual channels, where the first channel of each houses a strip of LEDs, and the second channel defines a channel into which an insert to be back or trans-illuminated can be inserted. Both dual channel members are attached to the post so that the first channels housing the strips of LEDs are positioned towards the post, while the second channels are positioned away from the post. The insert to be illuminated is receivable between the second channels (i.e., that face one another). The insert may include a house address number, or other characters cut-out or otherwise formed into the insert, so that light from the LED strips back or trans-illuminates the insert when received between the facing second channels. Deck rail lighting is also disclosed.

19 Claims, 8 Drawing Sheets

(56) References Cited

OTHER PUBLICATIONS

Prime Mailboxes, https://www.primemailboxes.com, accessed Jan. 13, 2020.
The Galaxy Steel Mailbox with LED Solar Light Cap and White Vinyl Post (White Mailbox), www.amazon.com, accessed Jan. 13, 2020.

LIGHTED MAILBOX POST OR SIMILAR STRUCTURE

CROSS-REFERENCE TO RELATED APPLICATIONS

The present application is a continuation-in-part under 35 U.S.C. 120 of U.S. patent application Ser. No. 17/144,127 filed Jan. 7, 2021, now U.S. Pat. No. 11,363,900, which claims the benefit under 35 U.S.C. 119(e) of U.S. patent application Ser. No. 62/963,955 filed Jan. 21, 2020, each of which is herein incorporated by reference in its entirety.

BACKGROUND OF THE INVENTION

1. The Field of the Invention

The present invention relates to mailboxes, particularly the support post typically used to support such.

3. Background and Relevant Art

While mailbox posts are available in a wide variety of configurations, there is a continuing need for improved configurations.

BRIEF SUMMARY

The present invention is directed to a mailbox post which includes lighting within the post, to back-illuminate an address (e.g., house number), name, or other characters or information, and which is reconfigurable, allowing a homeowner or other user to swap out whatever illuminated "cut-out" is inserted for illumination into the mailbox post, with another, as desired. For example, while a user may typically wish to have their street address provided in the mailbox or other post for illumination, it will be appreciated that they may wish to swap this out for a special occasion (e.g., a birthday party, use of a seasonal holiday "cut-out", etc.). The present invention provides for such functionality.

While the described illuminated cut-out or other features (e.g., address, name, etc.) can be positioned on a mailbox post, it will also be appreciated that such may be provided on any given post or other structure, whether a mailbox is present or not. For example, many homes include community mailboxes, and so may not include a dedicated mailbox for such a home, condominium, townhome, apartment, or other given address. The present configurations can of course thus be employed on other posts or other structures, apart from a mailbox (e.g., on a plaque, fence, railing, lamp post or other structure associated with a given home or other building.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the accompanying figures. It is appreciated that these figures depict only typical embodiments of the invention and are therefore not to be considered limiting of its scope. The invention will be described and explained with additional specificity and detail through the use of the accompanying figures.

DETAILED DESCRIPTION OF THE PREFERRED EMBODIMENTS

I. Introduction

The invention provides reconfigurable lighting configurations for a mailbox or other post. For example, the described configuration can allow a user to easily remove one lighted insert, to be replaced with another, e.g., a seasonal greeting, "happy birthday", or any other message or image to be presented, on the post.

II. Exemplary Lighted Post Systems

Figure 1:
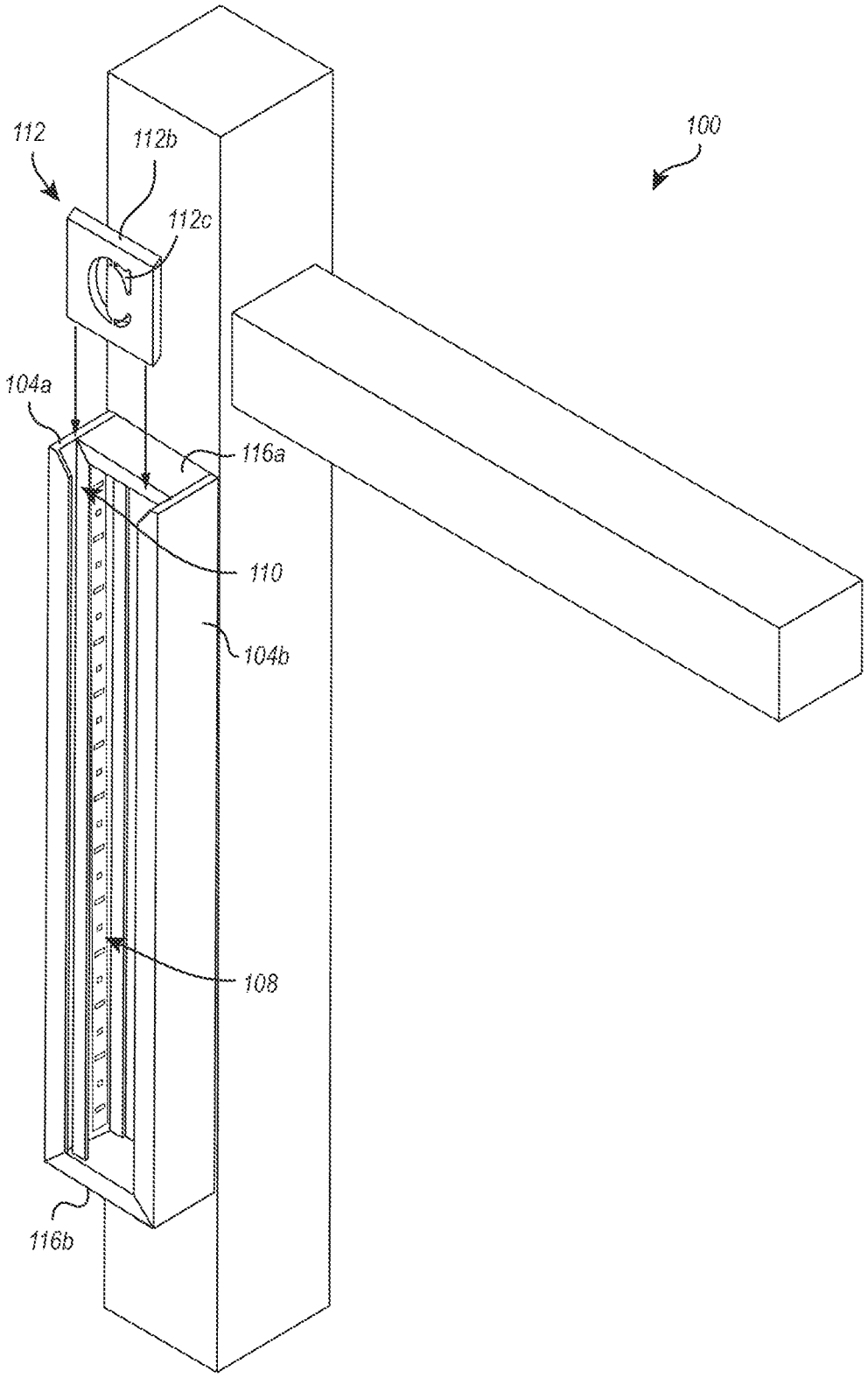
FIG. 1 shows a perspective view of an exemplary trans-illuminated mailbox post according to the present invention.
Figure 2:
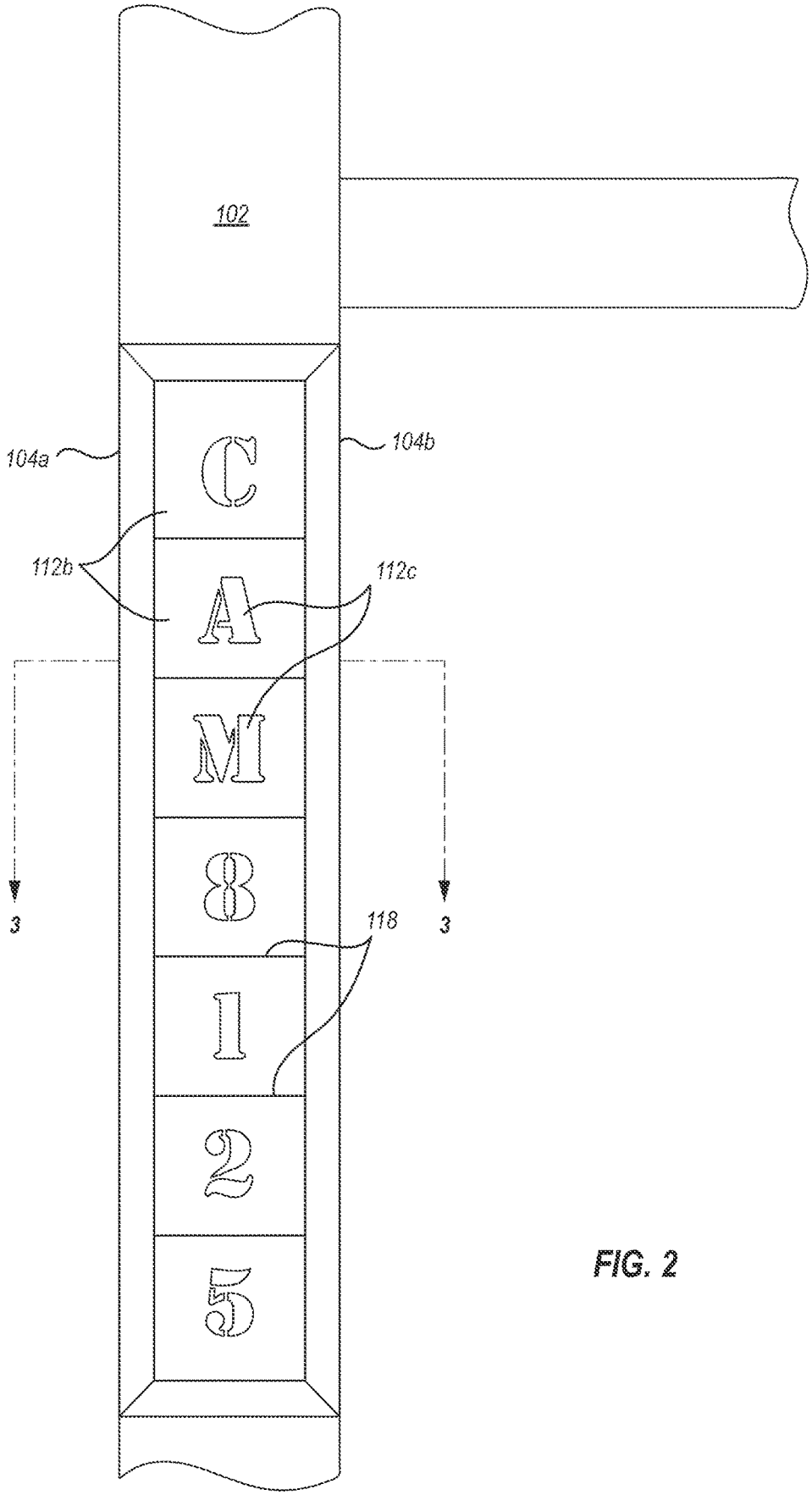
FIG. 2 shows a close up elevation view of the dual channel members of the trans-illuminated mailbox post as in FIG. 1, with trans-illuminated inserts received between opposed channels of the dual channel members.
Figure 3:
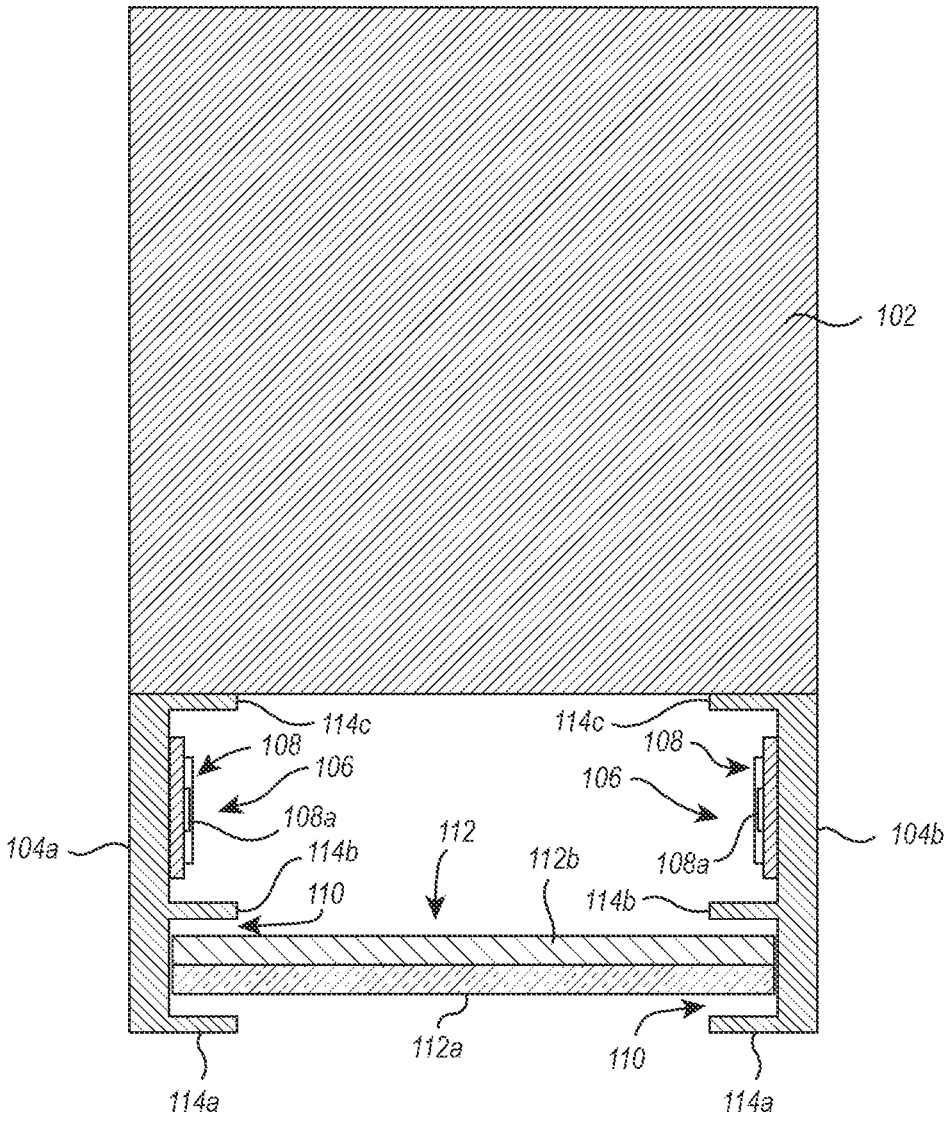
FIG. 3 shows a cross-sectional view through the structure shown in FIG. 2.

FIGS. 1-4 (as well as the additional photos and figures in the provisional, already incorporated by reference) illustrate various implementations that may include the configurations described herein. By way of example, a reconfigurable lighted post 100 (e.g., for a mailbox or otherwise) may include a post 102, and first and second dual channel members 104*a*, 104*b*, e.g., attached to the post 102. As shown in FIG. 3, each dual channel member 104*a*, 104*b* includes a first channel 106 that is sized to house a strip of LED lighting 108, and a second channel 110 (e.g., narrower than the first channel) into which an insert 112 to be illuminated can be inserted. The insert 112 can have address numbers, or other characters (e.g., any desired message, graphic, etc.) cut into the insert, or otherwise provided on the insert for trans-illumination (also referred to herein as back-illumination).

In the illustrated configuration both dual channel members 104*a*, 104*b* are attached to the post 102, where the first channels 108 of both dual channel members 104*a*, 104*b* are oriented towards the post 102, with the second channels 110 of both dual channel members 104*a*, 104*b* oriented away from the post 102. This positions the LED lighting 108*a* (other light source could alternatively be used, and "LED" is used for convenience, and because it works particularly well) next to the post 102. In other words, the LEDs 108*a* are positioned between the post 102 and the second channels 110 of the dual channel members 104*a*, 104*b*. The dual channel members 104*a*, 104*b* are attached to the post 102 so that the dual channel members 104*a*, 104*b* face one another, with the first channel 108 of member 104*a* facing the first channel 108 of member 104*b* and the second channel 110 of member 104*a* facing the second channel 110 of member 104*b*.

The insert 112 may be formed from an opaque material or layer 112*b* (e.g., metal, plastic, etc.), with one or more cut-outs therein, allowing the trans-illumination to occur. In one embodiment, the exterior face (e.g., front face or layer 112*a*) of the insert 112 may include a clear layer attached to such an opaque material layer 112*b*, such that the insert 112 may be a laminate of two attached layers (an opaque layer 112*b*, and a non-opaque layer 112*a*, that will allow the illumination from behind to pass through). Such a clear (e.g., translucent or transparent) layer 112*a* may aid in sealing off the interior of the structure, e.g., preventing bugs or debris from otherwise entering into the space defined between the dual channel members 104*a*, 104*b* (e.g., through the cut-outs 112*c*—see FIGS. 1-2).

In an embodiment, the layers 112*a*, 112*b* may be attached to one another (e.g., glued or the like), although in another embodiment, they may be separate, e.g., where the opaque layer 112*b* (e.g., or segments thereof—see FIG. 2) with desired cut-outs 112*c* is inserted into channel 110, and the clear layer 112*a* is inserted separately, thereover, covering the opaque layer 112*b*, or segments that make up the opaque layer 112*b*.

In an embodiment, the insert 112*b* itself could be formed from a translucent or transparent material, that would allow the desired illumination through the insert to occur, e.g., where a design of contrasting characters, graphics, or other design could be printed or otherwise provided on the insert, so that the light from the LEDs behind the insert would illuminate the design, through the insert.

The post 102 may be substantially vertical (e.g., so that the resulting address or other illuminated information is also oriented vertically). The post 102 could be substantially horizontal, such that the resulting address or other illuminated information would be horizontal. An angled, diagonal arrangement could also be provided. Horizontal or diagonal post orientations may allow hanging of the device (channels 104*a*, 104*b*) from such a post, as will be shown in subsequent Figures (e.g., FIG. 5).

The post 102 to which the dual channel members 104*a*, 104*b* are attached can be solid, hollow, etc. The configuration described herein could be retrofitted onto any already existing post, e.g., by attaching the channel members 104*a*, 104*b* as described herein, installing the LED strip lighting 108, and providing a desired insert for illumination.

The post 102 to which the dual channel members are attached may be secured to the ground, or to any other structure by any suitable means. For example, a length of the post 102 may be positioned in a footing, the bottom end of the post 102 may be bolted or otherwise secured to a platform, concrete pad, etc. It will be appreciated that numerous possibilities exist.

In an embodiment, the dual channel may be configured where the width of the first channel 106 (into which the LED strip lighting 108 is installed) has a width of about 0.5 inch to 1 inch. The width of the second channel 110 (which receives the insert 112 to be back or trans-illuminated) may be thinner, e.g., about 0.25 inch. In another embodiment, as described hereafter, the dual channel member may be configured as a triple channel member (see FIGS. 4-5), with channels 110 on either side of the channel 106. In such a configuration, channel 106 may have a width of 0.5 inch to 1 inch (e.g., 1 inch), while the adjacent channels 110 may have a width of about 0.25 inch. The overall structure may have a width of about 1.75 inches (including the wall thickness, separating such channels). Of course, such dimensions are merely exemplary, and channels of varying sizes or depths may be provided to accommodate larger or smaller inserts, differently sized LED strip lighting or other light source, etc.

The insert 112 may be in the form of a plurality of separate inserts or segments (e.g., each having one or more number or letter cut-outs, or other characters, graphics, etc.) which can be inserted by the user into the second channel 110, in any sequence desired, to spell out any desired message (e.g., resident's last name, "Happy Birthday", "Party Here Today", "Merry Christmas", the home or other address number, etc.).

As seen in FIG. 3, each member 104*a*, 104*b* may include a plurality of lateral protrusions or extensions, e.g., lateral extensions 114*a* and 114*b* defining channel 110 therebetween, and lateral extensions 114*b* and 114*c* defining channel 106 therebetween. Extension 114*c* may abut against post 102, providing a convenient location for attachment of members 104*a*, 104*b* to post 102. The insert 112 can be removably housed between extensions 114*a*, 114*b*, in channel 110, and the LED lighting strip or other lighting can be housed between extensions 114*b*, 114*c* in channel 106.

In an embodiment, the top (and/or bottom) of the $1^{st}$ channel 106 may be capped or sealed (e.g., by top and bottom caps 116*a*, 116*b*—see FIG. 1), e.g., to better protect the LED strip lighting 108 thereunder. The top of the $2^{nd}$ channel 110 may be accessible, e.g., either open (as shown in FIG. 1), or selectively covered by a cap or door, allowing a user to access the channel 110 for removal or insertion of desired inserts. As shown, the bottom of channel 110 is closed or capped by bottom cap 116*b*, to hold any inserts 112 therein, preventing them from simply falling out the bottom of the channel 110. As such, in an embodiment, top cap 116*a* may cover or cap at least channel 106, while bottom cap 116*b* covers or caps both channels 106 and 110.

Where the overall insert 112 is made up of a plurality of individual inserts (e.g., each with a single letter or number) as seen in FIG. 2, the adjoining edges 118 of such individual inserts may be beveled, routered, or similarly configured to provide a diagonal or stair-stepped interface between adjacent individual inserts. Such a configuration may better prevent dust, debris, bugs, or other undesirable materials from penetrating into the second channel 110, between such inserts. Where beveled, the angle associated with such a bevel may be such that the angle proceeds or is inclined upward (rather than downward) from the exterior surface inward, further minimizing or preventing water or other unwanted such materials from penetrating into the channel. Of course, such a beveled configuration is merely exemplary, and other various configurations may be employed for interfacing the inserts. For example, another embodiment could include a plate welded or otherwise attached to the back of one insert that will overlap the adjacent insert (e.g., the below insert). The inserts or other components described herein may be made of any of various suitable materials, e.g., plastic, metal (e.g., aluminum), or other suitable materials.

Figure 4:
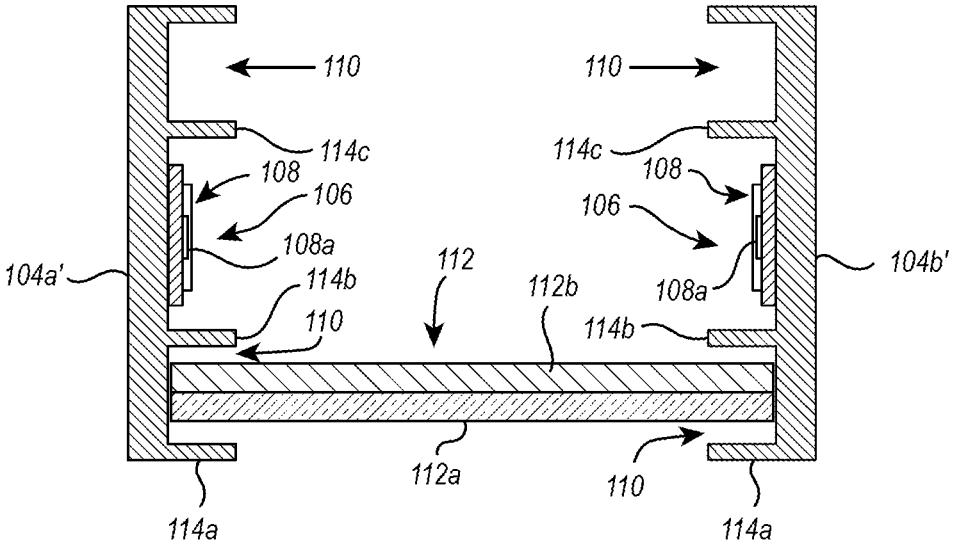
FIG. 4 shows an alternative configuration, with opposed triple channel members configured to receive inserts for trans-illumination.
Figure 5:
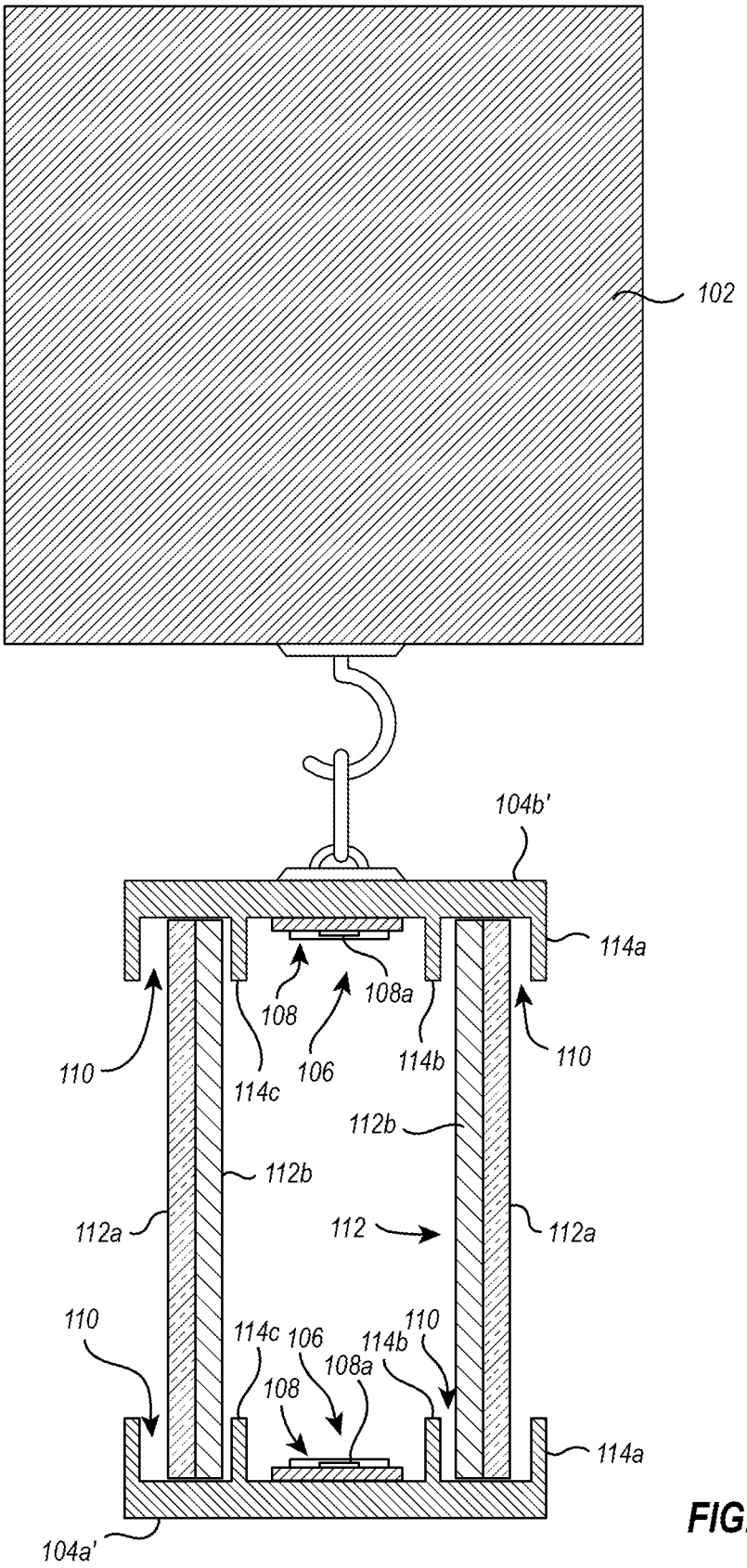
FIG. 5 shows how the configuration of FIG. 4 may be hung from a mailbox or other post, or other substrate.

In an embodiment, the dual channel members (104*a*' and 104*b*') may include a third channel (FIGS. 4-5). For example, such a third channel 110 may be similar or identical to the second channel 110 configured to receive the insert 112, but positioned on the opposite side of the first channel 106 that receives the LED strip lighting 108. For example, such a configuration may then include the first channel 106 that houses the LED strip lighting, and similar or identically configured second and third channels on either side thereof, so that both such second and third channels 110 can be illuminated by the LED strip lighting in the first channel 106 in the middle of such structure. Such a configuration may be beneficial where the dual channel (now a triple channel) is hung from a post (e.g., a horizontal post, e.g., below a mailbox) or even hung from the mailbox itself. Such a hanging configuration is shown in FIG. 5. In such a hanging configuration, there are 2 faces of the hanging triple channel that are now visible (e.g., on either side of the mailbox or other horizontal post), corresponding to the faces associated with inserts 112 (made up by 112*a* and 112*b*). This allows an address number, name, or other information to be presented on both sides of the LED strip lighting 108 in the first channel 106 (that is centered between the $2^{nd}$ and $3^{rd}$ channels 110 on either side). The information displayed in channels 110 (as a result of inserts 112) may be the same or different, as desired.

In an embodiment, the dual channel member (or a triple channel member) can be attached to the mailbox itself (e.g., rather than to the post). It will be apparent that such dual channel member could be attached to any desired substrate or structure, e.g., not limited to simply attachment to the mailbox post, or the like.

In an embodiment, any of the configurations described herein could include a solar panel and/or battery, e.g., to allow lighting of the LED strip lighting by means of a battery or other power storage device, which could be charged by the solar panel. Of course, any other power source could also be used to provide power to the LED or other light source within the channels (e.g., wind generated electrical power, connection to the powergrid, etc.).

Figure 6:
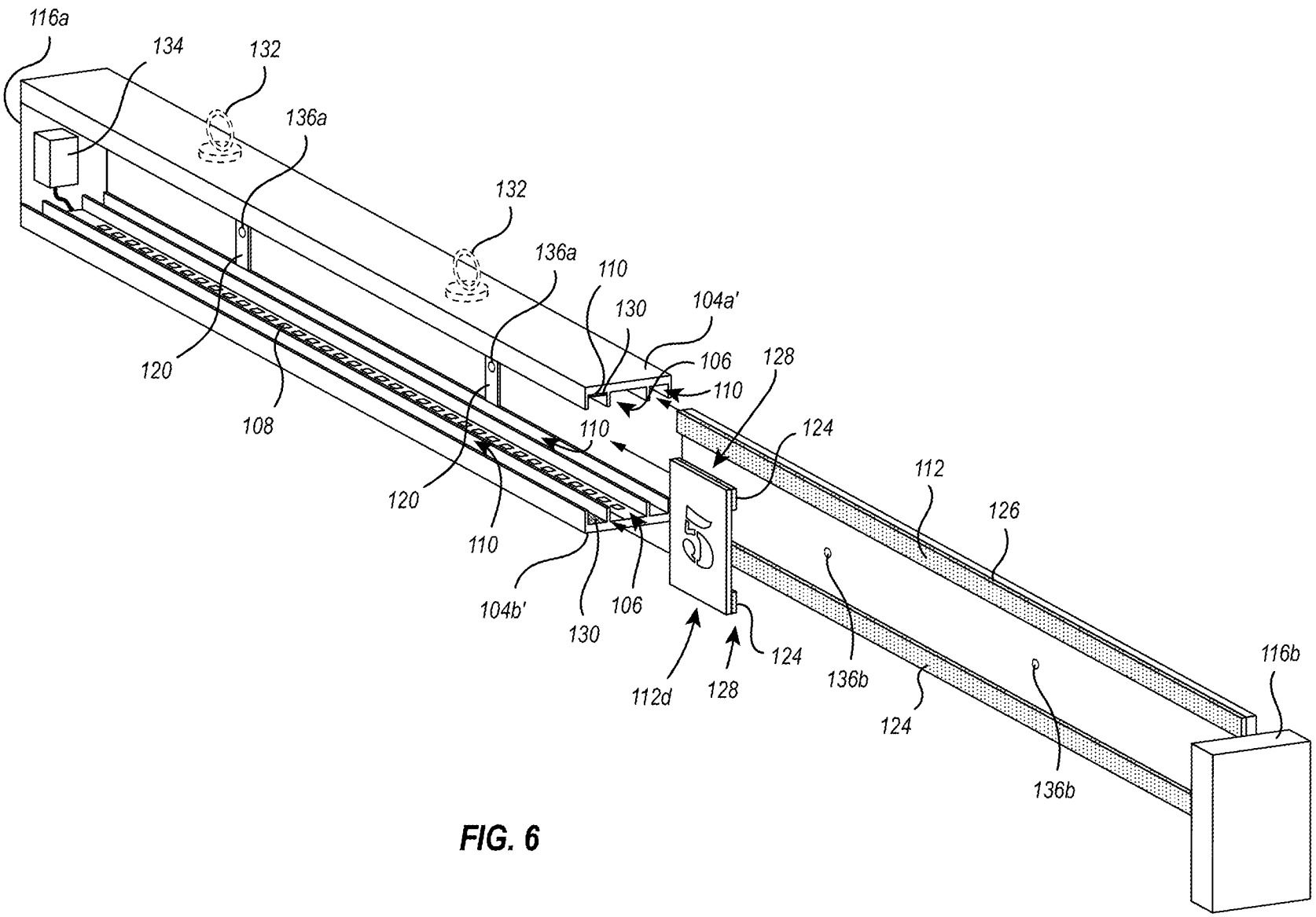
FIGS. 6-7 illustrate another alternative configuration.
Figure 7:
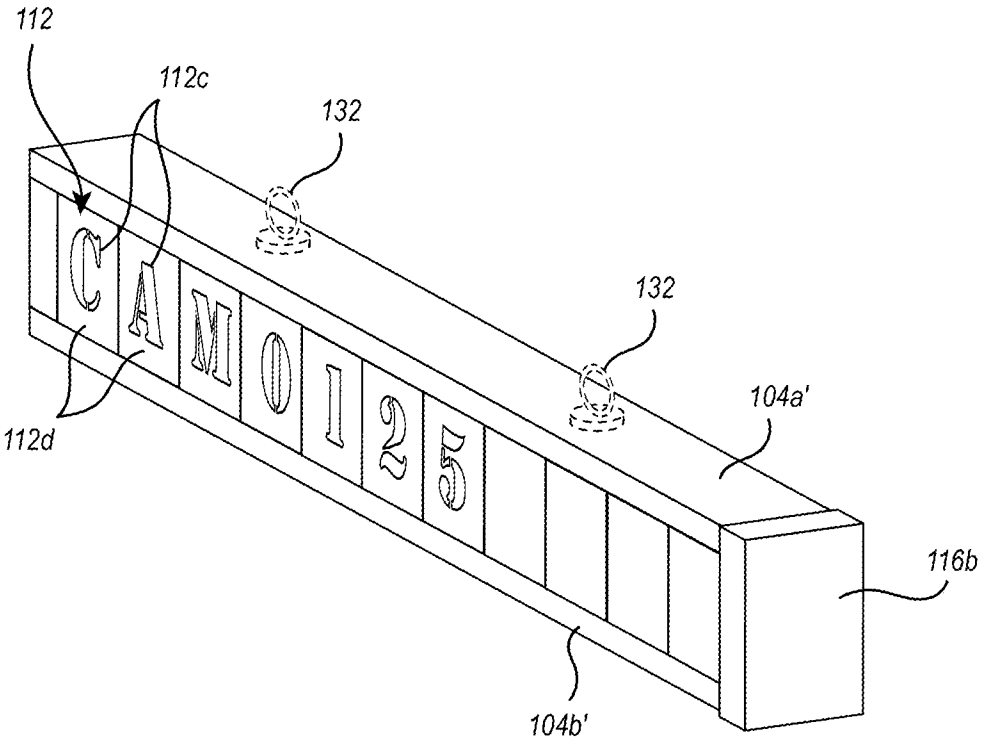

FIGS. 6-7 illustrate another embodiment similar to that shown in FIG. 5, which includes two triple channel members (104*a*' and 104*b*'). Each channel member 104*a*', 104*b*' includes two exterior outwardly oriented channels 110 as well as an interior channel 106, configured to receive LED strip lighting 108. Each of the outward channels 110 is configured to receive an insert 112 (either or both of which may include any desired cutouts 112*c*, for transillumination). If the device is to be directly mounted to a wall, post, or other structure, mounting brackets 120 could be provided. A mounting hole 136*a* as shown, can be provided, for mounting bracket 120 directly to a wall, post or other desired substrate, e.g., where no address or other information may be desired to be displayed through the rearmost channel 110 (adjustment mounting bracket 120). Where such is the case, the insert 112 inserted into such rearmost channel 110 may simply be opaque, if desired. While mounting bracket 120 may simply be welded to channel members 104*a*' and 104*b*', in another embodiment, a separate mounting bracket (e.g., with routered top and bottom ends so as to nest with wall 114*a*) could be provided, allowing the user to attach such a mounting bracket 120 at any desired location along the length of the channel members 104*a*' and 104*b*'.

A felt strip or other strip of fibrous material 124 can be provided along the interior sliding edges 126 of insert 112. In a similar manner a felt strip or other strip of fibrous material 124 can also be provided along the interior sliding edges 128 of each number or other character individual insert 112*d* that may make up the overall transilluminated front insert 112. Such felt or other material 124 may aid in providing easier sliding within channels 110, and may also minimize or prevent any rattling of the inserts relative to the channels 110, if windy, etc. A thin plastic or other film 130 may also be provided within one or more of any of channels 110, e.g., to prevent metal-on-metal contact, when sliding any of the inserts into such channels 110. Such may be beneficial where an insert is formed of metal, and the channel members 104*a*', 104*b*' are also formed of metal.

As shown, the channel device may include one or more hooks or eyelets 132 attached to one of the channel members (e.g., channel member 104*a*'), allowing such a device to be hung from a horizontal mailbox post or any other substrate. As noted, attachment may also be made to any desired substrate (post, wall, etc.) through mounting brackets 120. Mounting brackets may include mounting holes 136*a* as shown. Corresponding holes 136*b* may also be provided in rear insert 112, which become aligned with holes 136*a* of mounting brackets 120 when the rear insert 112 is fully inserted.

As shown in FIG. 6, an LED controller 134 may fit within the channel width of interior channel 106, particularly where such channel may be about at least about an inch in width. Alternatively, e.g., where the channel 106 is too thin to accommodate an LED controller, the controller could be mounted on the rear insert 112 (e.g., between address numbers or other characters, so as to not be visible during use).

Figure 8:
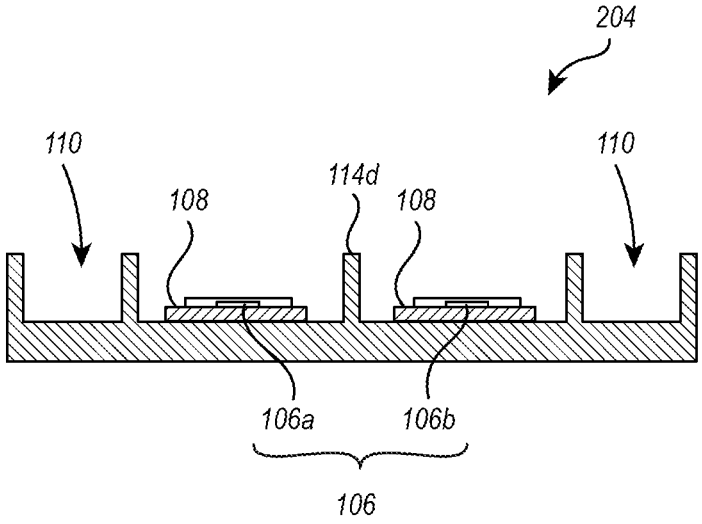
FIG. 8 illustrates another alternative configuration of a channel member.

FIG. 8 illustrates another embodiment of a channel member 204, similar to triple channel members 104*a*' and 104*b*', but in which central channel 106 has been divided, to define two internal sub-channels 106*a*, 106*b*, each including LED strip lighting 108. Such may be desired where additional light may be desired (e.g., to better illuminate transillumination inserts 112*d*, even in daylight. Divider 114*d* could extend to any desired length. In an embodiment, a corresponding channel member 204 may be oppositely positioned (e.g., a mirror image, relative to that shown in FIG. 8), to define the desired overall structure, ready to receive inserts). In an embodiment, divider 114*d* could extend the full length between such channel members 204, ensuring light from the right side LED strip lighting 108 only illuminates the insert in right channel 110, and light from the left side LED strip lighting only illuminates the insert in left channel 110. Such a channel member may be used in any of the device configurations described herein.

II. Exemplary Lighted Deck Rails

The photos and figures of the provisional application also show figures for providing a lighted deck rail system. For example, such a system could include a plurality of substantially vertical deck posts, and a rail extending across the top of the deck posts, where the rail includes a channel (e.g., routered or otherwise formed therein) in an underside of such a top rail. A strip of LEDs may be housed within such a channel in the underside of the rail, casting light from the LEDs downward, towards a bottom end of the deck posts.

The channel may be of various configurations, where the geometry of the channel in which the strip of LEDs is housed may alter the geometry of the light cast by the embedded lighting. For example, in an embodiment, the channel may be configured as a notch, open at the underside, but also open at an adjacent side of the rail (e.g., either the inside, or the outside of the rail), casting light in a more broad pattern, both downward, and to the open side. In another embodiment, the channel may be open only at the underside (not to the adjacent vertical sides of the rail). In an embodiment, the sidewalls of the channel may be at about 90° relative to the open underside of the channel, providing a relatively narrow downward casting of light. In another embodiment, the angle of the sidewalls can be less than 90° (e.g., 45°) relative to the open underside of the channel, providing a more widened downward casting of light. Schematic examples of such channel configurations are shown in the attached materials.

In another embodiment, the system may further include a bottom rail, extending across the bottom end of the deck posts, where the bottom rail includes a channel formed in a top side of the bottom rail, with a strip of LEDs housed within the channel in the top side of the bottom rail, so that light from the LEDs is cast upwards, towards the lighting that may be in the top rail.

As used in this specification and the appended claims, the singular forms "a," "an" and "the" include plural referents unless the context clearly dictates otherwise.

The present invention can be embodied in other specific forms without departing from its spirit or essential characteristics. Thus, the described implementations are to be considered in all respects only as illustrative and not restrictive. The scope of the invention is, therefore, indicated by the appended claims rather than by the foregoing description. All changes that come within the meaning and range of equivalency of the claims are to be embraced within their scope.

The invention claimed is:

1. A reconfigurable lighted display, comprising:

a substrate;

a first channel member attached to the substrate, the first channel member including at least two channels, where a first channel houses a strip of LEDs or other light source, and a second channel defines a channel into which an insert to be back illuminated can be inserted; and a second channel member also attached to the substrate, the second channel member including at least two channels, where a third channel houses a strip of LEDs or other light source, and a fourth channel defines a channel into which an insert to be back illuminated can be inserted;

wherein both the first and second channel members are attached to the substrate, facing one another, so that the first and third channels housing the strips of LEDs or other light sources are positioned towards the substrate, while the second and fourth channels are positioned away from the substrate;

further comprising an insert configured to be trans-illuminated, receivable between the second and fourth channels of the first and second channel members, the insert including an address number or other characters cut-out or otherwise formed in the insert, so that light from the LED strips or other light sources trans-illuminates the insert when received between the second and fourth channels.

2. The reconfigurable lighted display as recited in claim 1, wherein the first and second channels of the first channel member are of different widths, and the third and fourth channels of the second channel member are of different widths.

3. The reconfigurable lighted display as recited in claim 2, wherein the first channel and third channel which receives the strip of LEDs or other light source is wider than the second channel and fourth channel which receives the insert.

4. The reconfigurable lighted display as recited in claim 1, wherein the substrate to which the channel members are attached is substantially vertical, so that the address number or other characters being trans-illuminated extend vertically, along the substrate.

5. The reconfigurable lighted display as recited in claim 1, wherein the substrate to which the channel members are attached is substantially horizontal, so that the address number or other characters extend horizontally, along the substrate.

6. The reconfigurable lighted display as recited in claim 1, wherein the substrate is solid.

7. The reconfigurable lighted display as recited in claim 1, wherein the substrate is hollow.

8. The reconfigurable lighted display as recited in claim 1, wherein the channel members each further include a fifth channel on a side of the first channel or third channel that is opposite that of the second channel or fourth channel, the fifth channel being configured such that another insert can be inserted therein.

9. The reconfigurable lighted display as recited in claim 8, wherein the insert in the fifth channel is also trans-illuminated by the LEDs or other light source in the first channel and third channel.

10. The reconfigurable lighted display as recited in claim 8, wherein the first channel of the first channel member is sandwiched between the second channel on one side and the fifth channel on an opposite side, and the third channel of the second channel member is sandwiched between the fourth channel on one side and the fifth channel on an opposite side.

11. The reconfigurable lighted display as recited in claim 1, further comprising a mailbox, wherein the substrate supports the mailbox.

12. The reconfigurable lighted display as recited in claim 8, wherein the first and second channel members are directly or indirectly attached to the substrate, or wherein the first and second channel members hang from the substrate.

13. The reconfigurable lighted display as recited in claim 12, wherein the substrate is substantially horizontal.

14. The reconfigurable lighted display as recited in claim 8, further comprising one or more mounting brackets extending between the first and second channel members.

15. The reconfigurable lighted display as recited in claim 8, further comprising a felt strip or other fibrous material on inserts to be received into the second and fourth channels, or into the third channels, to minimize rattling of inserts in the channels.

16. The reconfigurable lighted display as recited in claim 8, further comprising a plastic or other film within the second, fourth, and/or third channels to minimize or prevent metal-on-metal contact, where the channel members comprise metal, and the inserts comprise metal.

17. The reconfigurable lighted display as recited in claim 8, wherein the first and third channels are themselves divided into two sub-channels, where a strip of LEDs or other light source is provided within each of the sub-channels.

18. The reconfigurable lighted display as recited in claim 12, wherein the reconfigurable lighted display is a reconfigurable lighted mailbox post.

19. The reconfigurable lighted display as recited in claim 12, wherein the substrate is a post.

* * * * *